US007188658B1

(12) United States Patent
Nordstrom et al.

(10) Patent No.: US 7,188,658 B1
(45) Date of Patent: Mar. 13, 2007

(54) RETRACTABLE ARCHED WINDOW COVERING

(75) Inventors: John E. Nordstrom, P.O. Box 377, 8221 White Cliff Rd., Egg Harbor, WI (US) 54209; Alan F. DeBauche, Two Rivers, WI (US)

(73) Assignees: John E. Nordstrom, Egg Harbor, WI (US); Barbara A. Nordstrom, Egg Harbor, WI (US)

( * ) Notice: Subject to any disclaimer, the term of this patent is extended or adjusted under 35 U.S.C. 154(b) by 283 days.

(21) Appl. No.: 10/911,382

(22) Filed: Aug. 3, 2004

(51) Int. Cl.
*E06B 3/94* (2006.01)

(52) U.S. Cl. ..... 160/84.07; 160/84.07; 160/134

(58) Field of Classification Search ..... 160/84.07, 160/134, 84.02, 168 IP
See application file for complete search history.

(56) References Cited

U.S. PATENT DOCUMENTS

| | | | | | |
|---|---|---|---|---|---|
| 4,699,195 | A | | 10/1987 | Lester | |
| 4,776,380 | A | * | 10/1988 | Lester | 160/134 |
| 4,807,686 | A | | 2/1989 | Schnebly et al. | |
| 4,830,081 | A | | 5/1989 | Morris | |
| 4,934,434 | A | | 6/1990 | Schnebly et al. | |
| 4,934,436 | A | | 6/1990 | Schnebly | |
| 5,010,939 | A | * | 4/1991 | King | 160/84.07 |
| 5,117,889 | A | * | 6/1992 | Coe | 160/134 |
| 5,139,070 | A | | 8/1992 | Kidd | |
| 5,159,966 | A | * | 11/1992 | Fleishman et al. | 160/84.07 |
| 5,168,912 | A | | 12/1992 | Jelic et al. | |
| 5,197,526 | A | | 3/1993 | Schon | |
| 5,205,337 | A | | 4/1993 | Bozzo | |
| 5,584,329 | A | * | 12/1996 | Thomas | 160/134 |
| 5,662,153 | A | | 9/1997 | Rosenblatt | |
| 5,765,619 | A | | 6/1998 | Arnold | |
| 5,771,953 | A | | 6/1998 | Benthin | |
| 5,794,680 | A | * | 8/1998 | Xue | 160/84.07 |
| 6,029,733 | A | | 2/2000 | Xue | |
| 6,065,523 | A | * | 5/2000 | Sanz | 160/84.02 |
| 6,390,172 | B1 | * | 5/2002 | Fleishman et al. | 160/168.1 V |
| 6,820,674 | B2 | * | 11/2004 | Abita et al. | 160/84.07 |
| 6,877,546 | B1 | * | 4/2005 | Garcia | 160/134 |
| 7,048,027 | B1 | * | 5/2006 | Abita | 160/84.07 |

OTHER PUBLICATIONS

The Beautiful Arch Retracta Blind website; www.archeblind.com Sep. 21, 2002.

* cited by examiner

*Primary Examiner*—Hugh B. Thompson, II
*Assistant Examiner*—Candace L. Bradford
(74) *Attorney, Agent, or Firm*—Alan R. Stewart; Godfrey & Kahn, S.C.

(57) ABSTRACT

A retractable window covering for arched or palladian style windows. The covering has a pair of shade members that can be remotely operated by an activator such as a pull cord for opening and closing the shades. The shade members are suspended from a carriage that is movable within an arched track. The shade members can be drawn along the track in opposite directions independently from a horizontal retracted position to an expanded position such that the shade members meet at the apex of the arched window. The present invention includes an embodiment that includes a shield to cover a portion of the drive assembly resting on the window sill or other horizontal surface.

22 Claims, 14 Drawing Sheets

158
160
162
164
166
168

RETRACTABLE ARCHED WINDOW COVERING

BACKGROUND OF THE INVENTION

The present invention relates to a retractable covering for arched windows. More specifically, the invention is a shade assembly for arched windows which can be opened and closed without manually moving the shade.

Many new buildings and homes are designed with arched windows or palladian style windows and doors. Today, there are several types of coverings available for arched windows, but many tend to be either permanently fixed, that is, not retractable, or they are manually opened and closed. While there do exist several retractable style arched window covers, these designs lack aesthetic appeal, which can severely diminish their value as a decorative item, or they are too cumbersome to use, especially for larger diameter arched windows. Due to design limitations, retractable window coverings are not available for arched windows having relatively large diameters. In addition, the mechanisms may be relatively complex or unattractive.

For instance, U.S. Pat. No. 4,699,195 and U.S. Pat. No. 4,776,380, both issued to Lance Lester, disclose a shade for use in an arched window. The shade includes a U-shaped frame with two sets of blades, each fanning out from a respective side of the frame. The blades meet at the top of the arched frame where they are latched together to hold the blades in place. The patents to Lester do not disclose a shade that can be remotely operated.

U.S. Pat. No. 5,117,889, issued to David G. Coe, discloses an arched window shade constructed of multiple slats strung together which pivot either manually or mechanically from a rigid base to cover the window. The Coe apparatus has relatively complex structure and does not appear to cover the entire arched window.

U.S. Pat. No. 5,159,966, issued to Ron Fleishman et al. describes a fan-type arched window covering having compression plates which engage the opposed sides of radial pleats. Compression plates engage the opposed surfaces of the radial pleats to partially compress and rigidify the pleats. Further, the plates enable adjustment of the pleats to accommodate irregularities in the window casing with the blind supporting itself. The patent to Fleishman et al. does not disclose a window covering which can be folded or opened.

U.S. Pat. No. 5,794,680, issued to Xue discloses a retractable arched window covering. A pleated fan-style shade is attached to a hub rail on the center portion of a base attached a window sill or the like. The base hides the retracted covering, which stacks on one side of the window. The shade is suspended from an arched track member. A single activator such as a pull cord operates the shade, pulling from one side of the base to the other to completely cover the window. In another embodiment, there are two shades which are stacked on separate sides of the window. However, the patent does not disclose a covering that does not require specially-made shade members.

Consequently, there remains a need for a retractable shade assembly having a cover that can be remotely operated to in order to open or close the cover. Preferably, the covering hides the unattractive mechanical elements of the invention that are in plain view to give it an aesthetically pleasing appearance. The covering may be capable of diffusing or blocking sunlight while the covering is in the closed position. Furthermore, the covering preferably accomplishes these goals using a relatively simple mechanical assembly, and with shade members that are readily available with little or no modification.

SUMMARY OF THE INVENTION

A retractable window covering for covering an arched window is presented. Generally, the window covering includes an arched track having an interior channel. A carriage that is movable within the interior channel of the arched track has a shade member attached thereto. The carriage is attached to a drive assembly which may be remotely operated.

The drive assembly forms a closed loop and is disposed within the interior channel of the track. The drive assembly may be a dual chain/cable combination that extends along the arched track diameter and through the track. The drive assembly further includes two sprocket-and-pulley assemblies, one attached to each side of the track, to engage each chain/cable combination used to operate the respective shade members. In other aspects of the invention, gear assemblies are attached to the sprocket-and-pulley assemblies so that the shades may be opened and closed with relative ease.

In operation, a rotation device used to activate the drive assembly may be accessed from each side the track. In one embodiment, a pull cord remotely operates the shade member located on that side of the track. The shade member may be open or closed partially or completely, depending on the desired effect.

While the present invention is particularly useful in covering arched windows, the components used should not be deemed to limit the application of the present invention. The present invention may be advantageously adapted for use where similar performance capabilities and characteristics are desired. These and other objects and advantages of the present invention will become apparent from the detailed description, claims, and accompanying drawings.

DETAILED DESCRIPTION OF THE PREFERRED EMBODIMENTS

Figure 1:
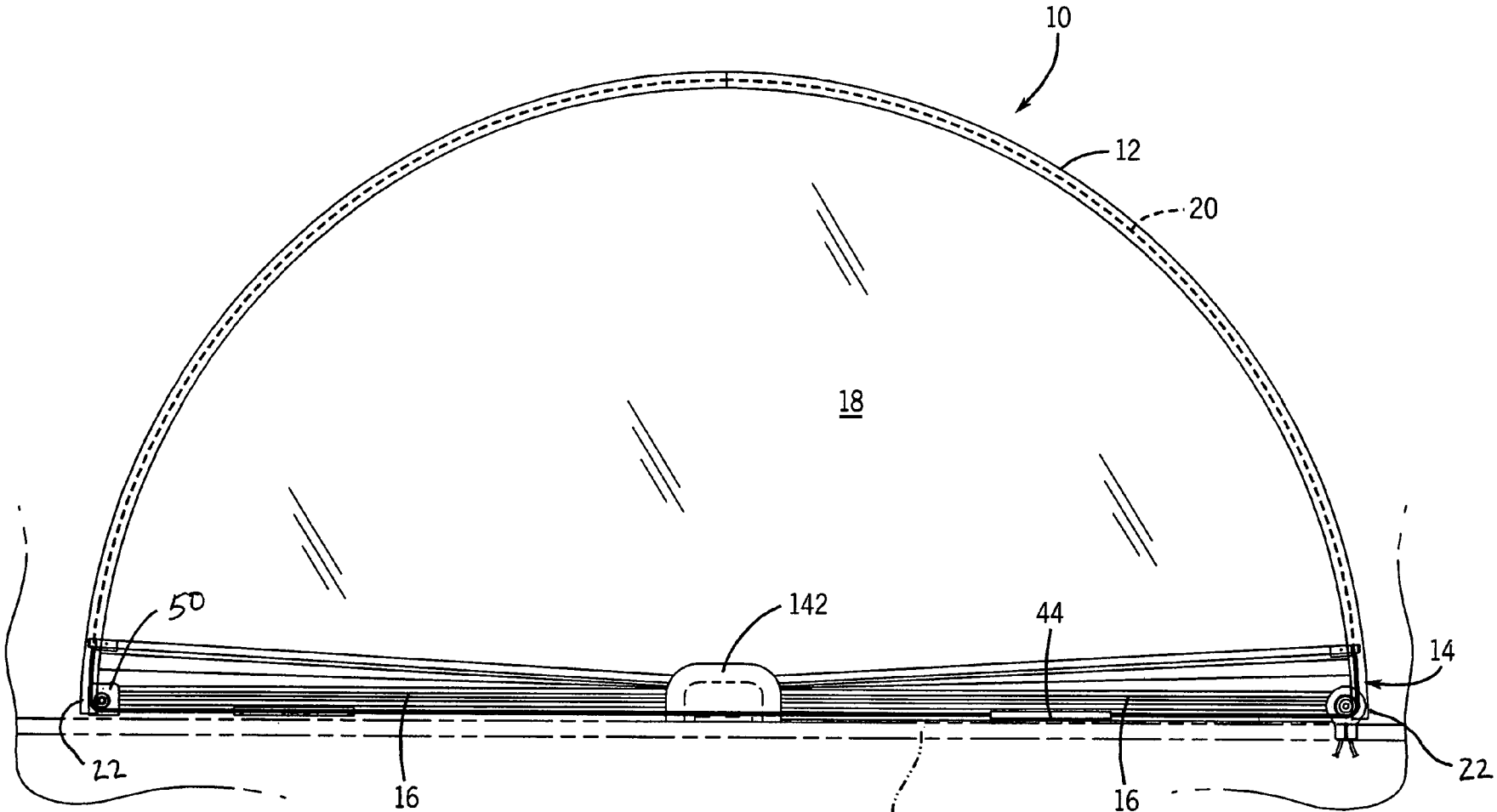
FIG. 1 is a front elevational view of a window covering constructed according to a preferred embodiment of the present invention, showing the window covering in an open position to allow direct light to pass through the window.
Figure 2:
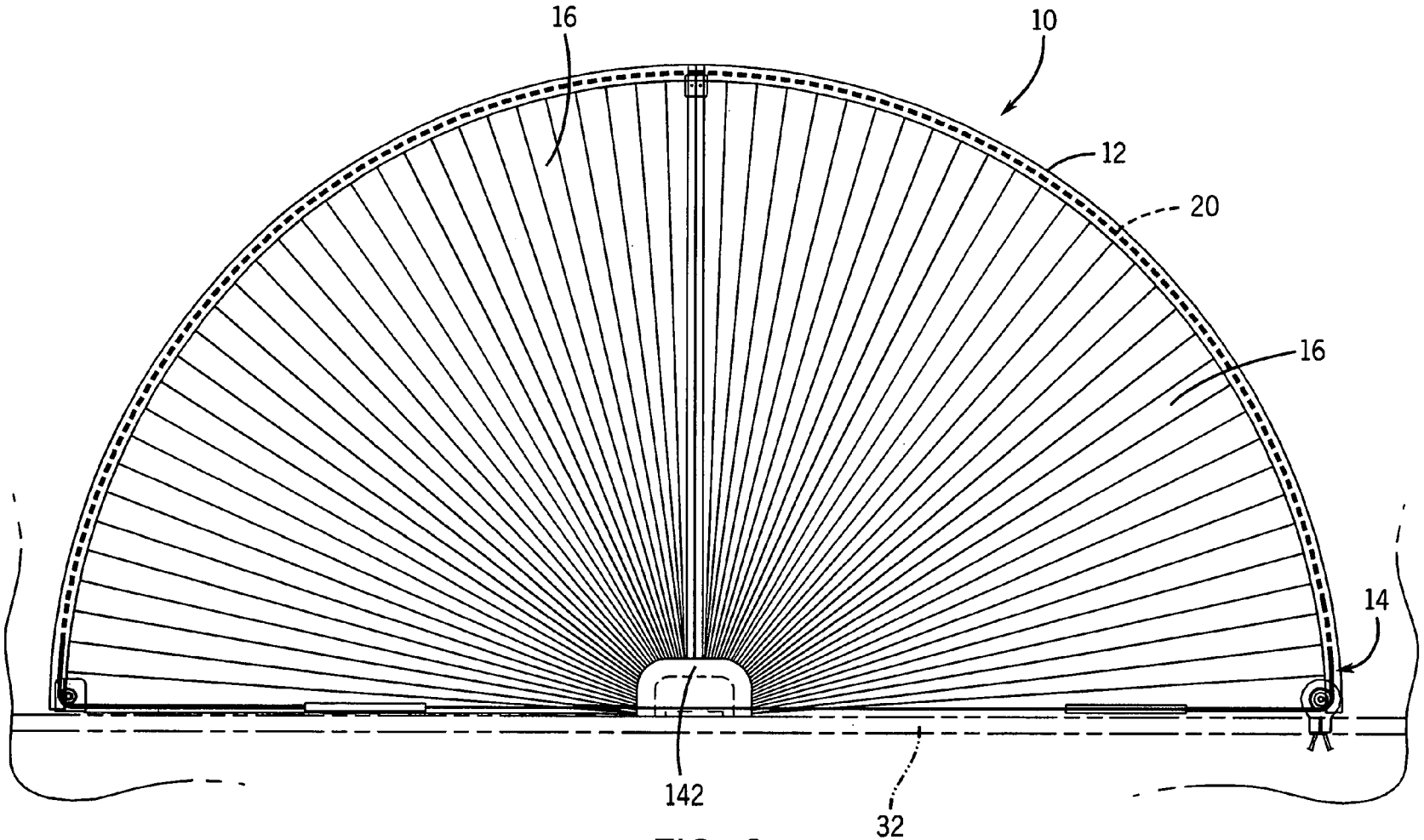
FIG. 2 is a front elevational view of the window covering shown in FIG. 1, showing the window covering in a closed position.

FIGS. 1 through 18 show various views and embodiments of the retractable arched window covering of the present invention. Referring to FIGS. 1 and 2, the covering 10 preferably includes an arched track 12, and a drive assembly 14 that operates a pair of shade members 16 so that each shade member can be selectively opened and closed either together with or independently from the other. The track 12 has the capability of fitting into an existing window frame (not shown), and each shade member 16 preferably covers up to one half or more of the surface area of a window 18. Of course, the invention is not limited to semi-circular windows, but to any window having a substantially circular arc at one edge.

Figure 3:
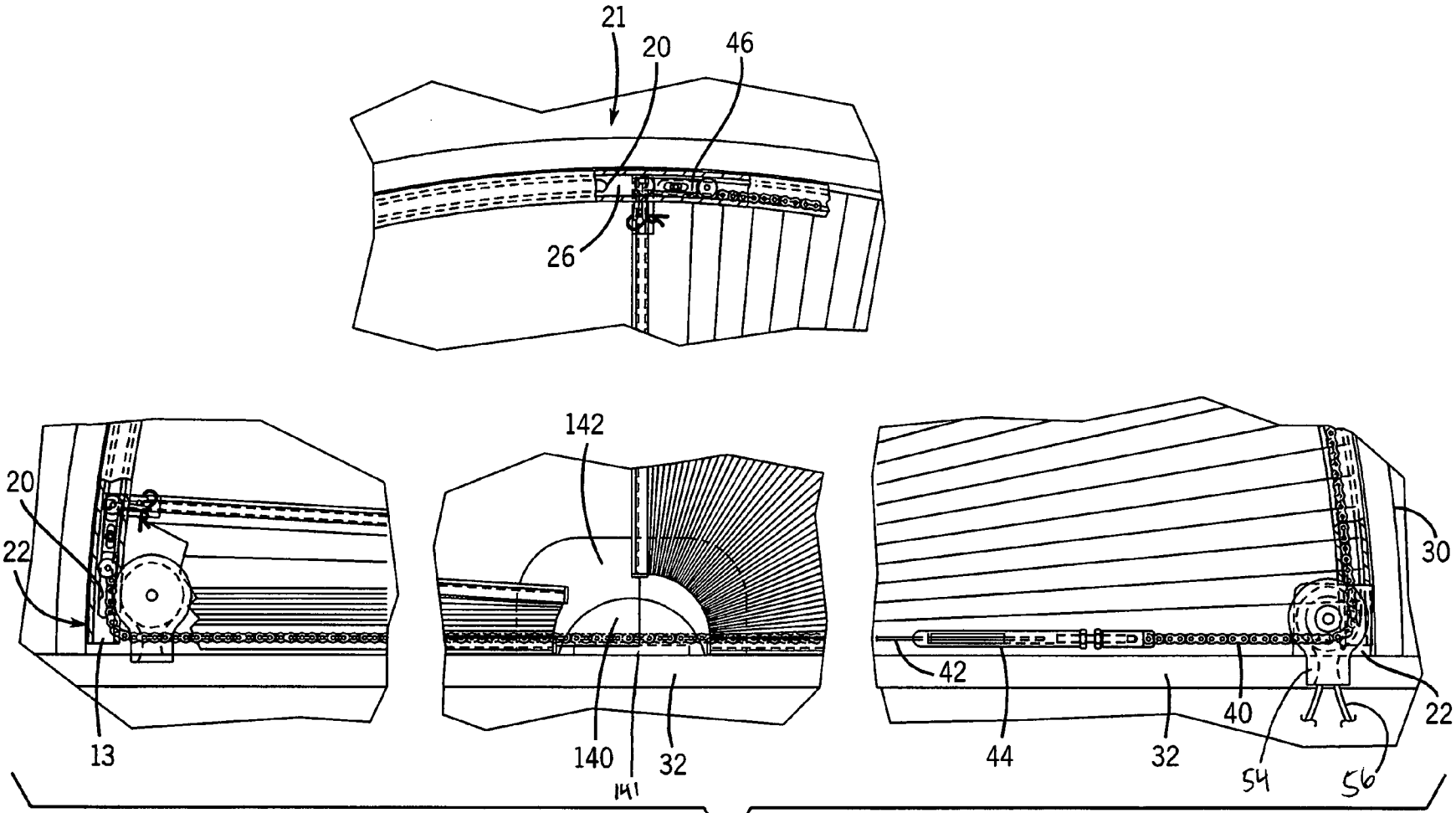
FIG. 3 is a front elevational, partially fragmented view of the window covering shown in FIGS. 1 and 2, showing further detail of the window covering assembly.
Figure 8:
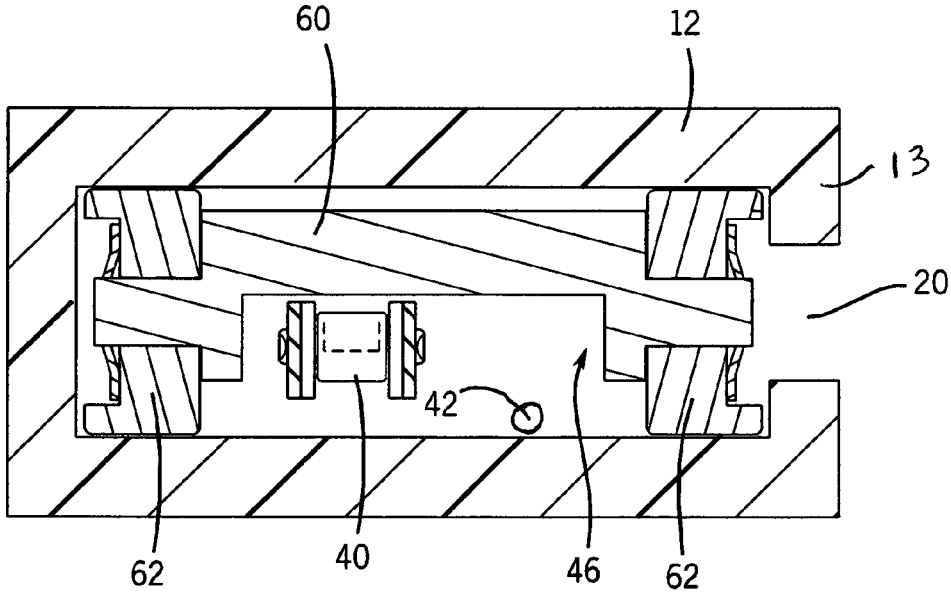
FIG. 8 is a partial cross-sectional view of the carriage shown in FIG. 6, showing its relationship to a cable and chain and the track.

Referring to FIGS. 1, 3 and 8, the track 12 is the primary support structure for covering 10, and may be constructed from an extruded metal channel that is bent to fit an arched window frame. Most preferably, the track 12 is an aluminum alloy because it is easily workable and has a relatively high strength-to-weight ratio. Track 12 is hollow, enabling it to house a portion of the drive assembly 14, as described below. As best seen in FIGS. 3 and 8, the rear face 13 of track 12 has a slot 20. Preferably, this slot 20 continues from each end 22 of track 12 up to the track apex 21. At the apex 21, there is preferably a bridge 26 interrupting the otherwise continuous slot 20. The purpose of bridge 26 is to prevent each shade 16 from covering more than one half of the window 18. However, if desired, a single shade could be used to cover the entire window. In that case, bridge 26 would be omitted from the slot 20.

Figure 4:
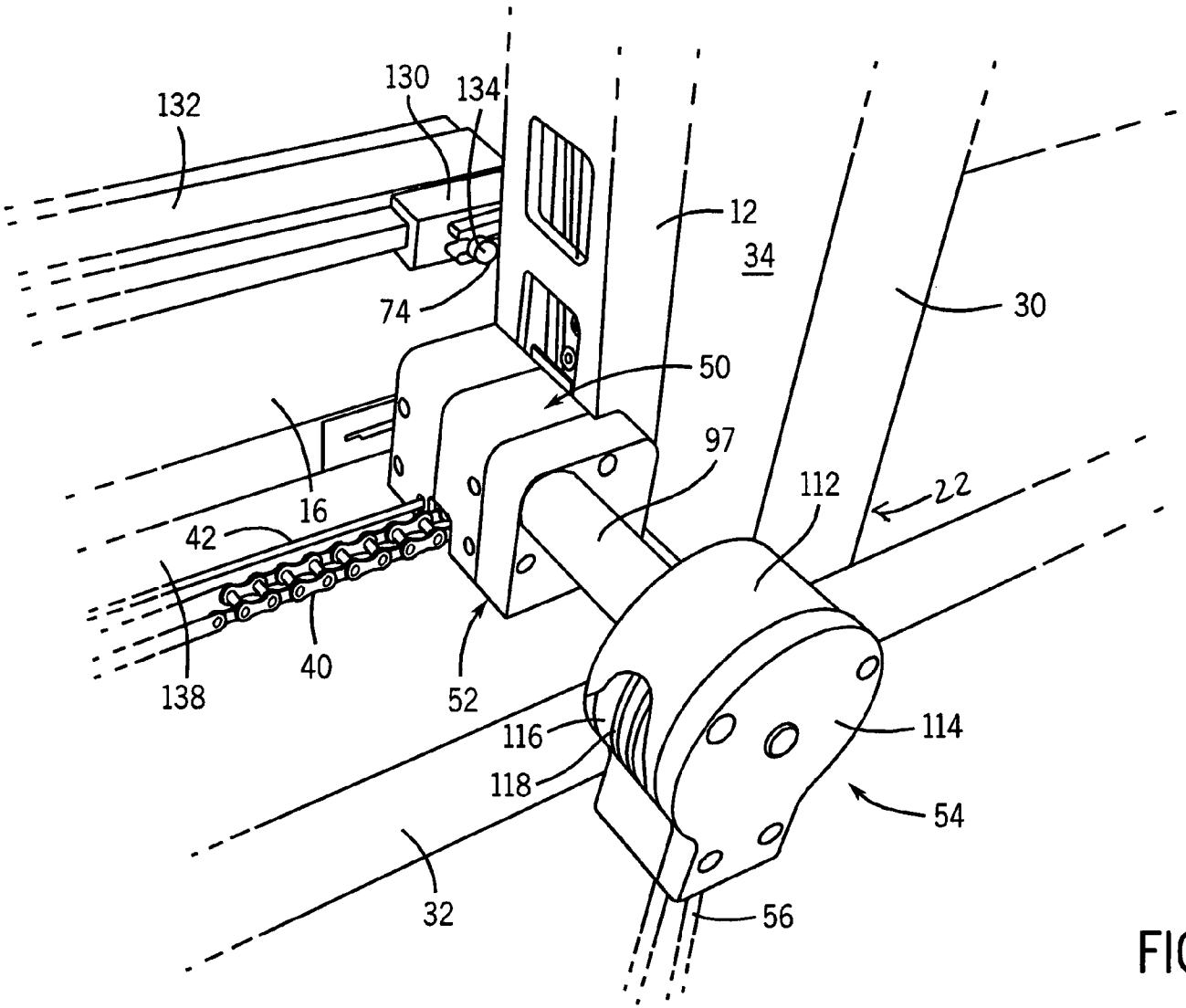
FIG. 4 is a partial perspective view of the window covering shown in FIG. 1, showing the sprocket, gear and rotator assemblies in relation to the track.

Referring to FIGS. 3 and 4, track 12 may be used in a window frame 30 that includes a sill plate 32. In this case, the ends 22 of track 12 abut sill plate 32, and the remaining portion of track 12 conforms to the interior surface 34 of window frame 30, see FIG. 4. If a sill plate 32 is not present, a support bracket is used, as described more fully below.

Figure 5:
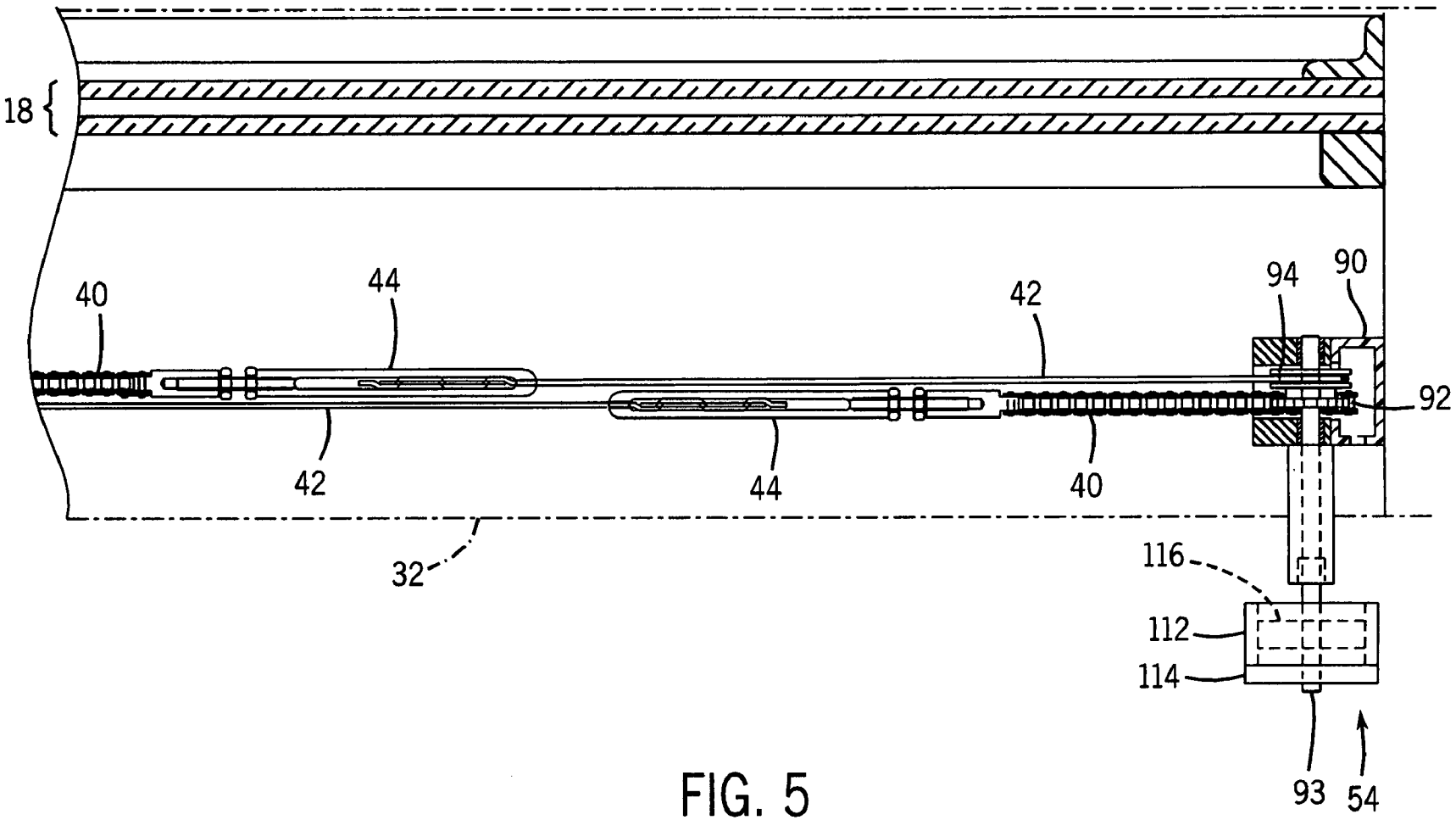
FIG. 5 is a top plan view, partially in section, of a portion of the window covering shown in FIG. 1, showing an embodiment of the driving apparatus, particularly how the chain and cables engage sprocket and rotator assemblies.

Referring now to FIGS. 3 through 5, the drive assembly 14 has several components, preferably: a pair of chains 40, each connected to a corresponding one of two cables 42; a tension adjuster 44 for connecting together, and adjusting the tension of, each chain/cable combination; a pair of carriages 46, each capable of moving one of the chains 40 and corresponding cables 42 within the track 12; a pair of driving apparatuses 50, one located at each end 22 of the track 12, and preferably, an optional gear assembly 52 corresponding to each driving apparatus 50; and a rotator assembly 54 for operation by an activator such as pull cord 56.

Each chain 40 and cable 42 is connected together to form each of two separate and complete loops. Each loop is used to operate a separate shade member 16. Each loop is positioned in side-by-side relation to the other loop inside the hollow channel of track 12 and further extends between ends 22 of the track. There are two connections for each loop. A first connection between chain 40 and cable 42 may be made by attaching the chain 40 to one end of a tension adjuster 44, and one end of the cable 42 to the opposite end of the tension adjuster 44. Most preferably, tension adjuster 44 is a turn-buckle-style adjuster as shown in FIG. 3. Of course, other connectors may be used instead of the tension adjuster 44. The remaining end of cable 42 is attached to one end of a carriage 46, and the remaining end of the chain 40 is attached to the opposite end of carriage 46. See FIGS. 3 and 7. Preferably, the chain 40 is about 30 to 35 percent of the loop formed by connecting chain 40 to cable 42. Also, it is preferable to use a coated cable 42 to reduce friction. Suitable coatings for cable 42 include vinyl, TEFLON, plastic or the like.

In an alternative embodiment, an optional cover (not shown) may be used to cover the chain 40 and cable 42 that lies exposed on the window sill or window sill substitute. Of course, if the window sill is high enough, the chains 40 and cable 42 cannot be seen when the covering 10 is viewed from the floor. A cover may be constructed from a C-shaped channel or the like and fastened directly to the window sill.

Figure 6:
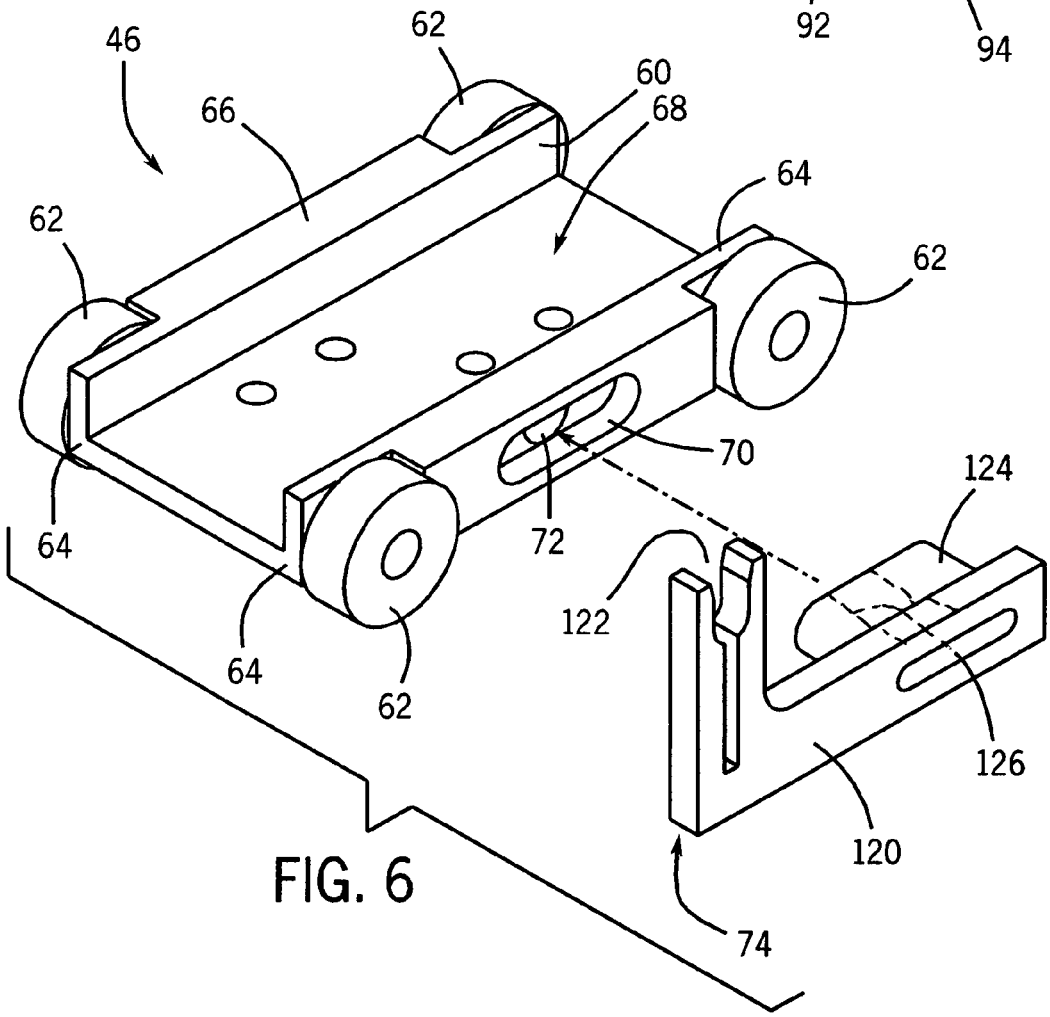
FIG. 6 is a perspective view, partially exploded, of the driving apparatus shown in FIG. 1, specifically showing the clip member and carriage.
Figure 7:
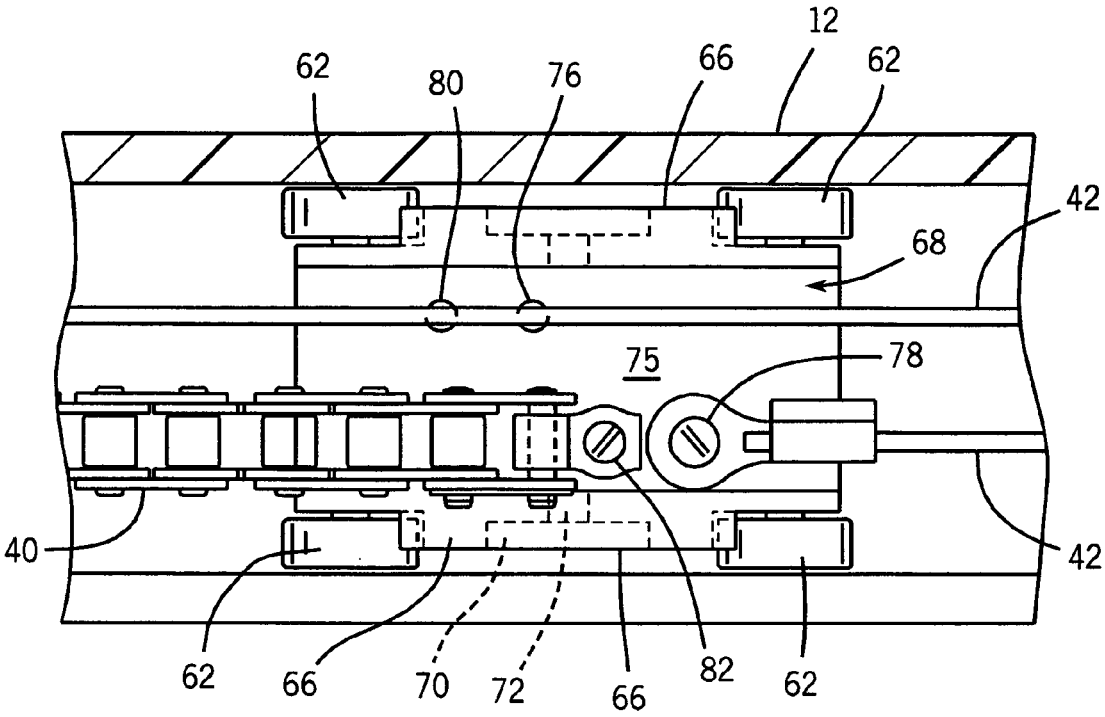
FIG. 7 is a partial plan view of the carriage shown in FIG. 6, connected to a cable and chain.

Referring now to FIGS. 6, 7 and 8, in the preferred embodiment, the carriage 46 may be made of a chassis 60 having four wheels 62 connected to it, one to each corner 64 of the chassis. Preferably, each corner 64 is recessed with respect to the exterior sides 66 of the chassis 60. The top of chassis 60 has a recessed channel 68 running the length thereof. The purpose of channel 68 is to accommodate both sets of chains 40 and cables 42, as described herein. On one of the sides 66 is an elongated recess 70 for receiving a clip member 74, described below. As shown in FIG. 7, an aperture 72 extends from the recess 70 to the channel 68. Aperture 72 receives a fastener (not shown) for attaching the clip member 74 to the chassis 60.

Chassis 60 may be machined from a material such as metal (e.g. aluminum alloy) or molded from a material such a plastic. The wheels 62 are preferably made from a non-metal material. Alternatively, carriage 60 may be constructed from a single part that does not have wheels (not shown). For example, carriage 60 could be made from TEFLON, nylon, or any suitable material that can slide through track 12.

As best seen in FIG. 7, most preferably, there are two sets of apertures located on the floor 75 of chassis 60 (only one set is actually shown in FIG. 7, apertures 76 and 80). There is a first set of apertures located on one side of floor 75, and a second set of apertures are located on the opposite side of floor 75. The two sets of apertures may be staggered to avoid interference between any connectors used to connect drive assembly parts to the chassis 60. For example, when carriages 46 are located adjacent to one another at the top of track 12, connectors attached to the top of chassis 60 could interfere with the closing of the shade members 16. Preferably, each set of apertures are aligned with the longitudinal axis of carriage 46. For the first set of apertures, a first chain 40 is connected with a fastener 82 at a corresponding aperture, and a first cable 42 is connected with a fastener 78 at the other corresponding aperture. Preferably, the second set of apertures are aligned with a second cable 42 as shown. Of course, each carriage 46 needs only one set of apertures, but having a second set available omits the need for two separate inventories of carriages.

Only a single chain 40 and corresponding cable 42 is connected to a single carriage 46—both such connections being made on a single side of the carriage chassis 60. Because there are up to two carriages 46 residing in a single track 12 having a single channel, the first carriage 46 has room within its carriage channel 68 to accommodate the second cable 42 attached to the second carriage 46, and vice-versa. For example, as the first carriage 46 moves within the hollow track channel, the second cable 42 remains undisturbed. FIG. 8 is a cross-sectional schematic view of track 12 containing a first carriage 46, the first carriage having a first chain 40 attached thereto. Adjacent first chain 40 is a second cable 42 that is attached to a second carriage 46 (not shown). The clearance between second cable 42 and first carriage 46 is large enough so that there is no interference between these two components which would hinder movement of the first carriage 46.

Figure 5A:
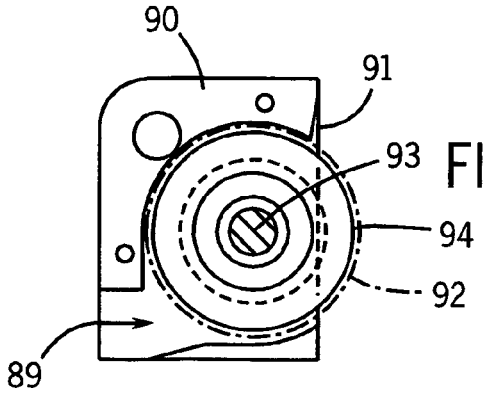
FIG. 5*a* is a side elevational view of the driving apparatus shown in FIG. 5.
Figure 5B:
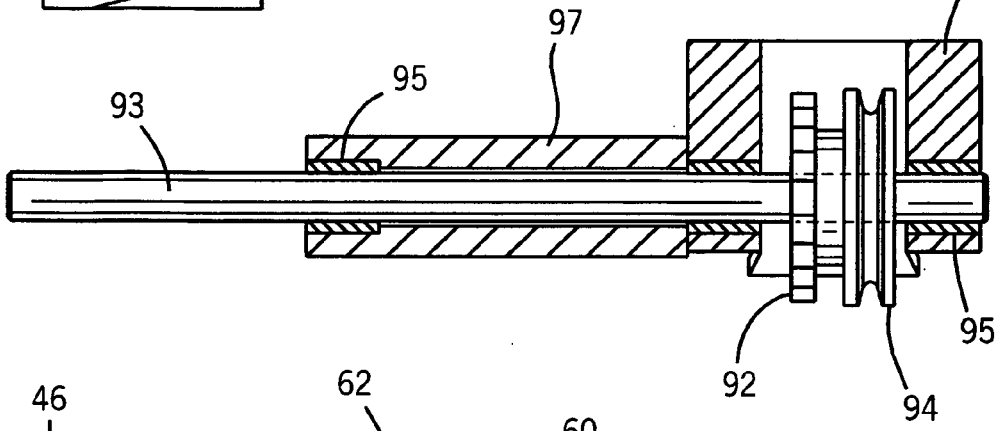
FIG. 5*b* is a top plan view of the driving apparatus shown in FIG. 5.

Referring to FIGS. 5 and 5*a*–*b*, chain 40 engages a driving apparatus 50 that may be generally constructed from a sprocket 92 and an idler pulley 94 contained within a sprocket housing 90. Sprocket 92 is connected to a rotatable drive shaft 93 that is supported by bushings 95 and a drive shaft support 97. The pulley 94 may be slip fit onto the hub of sprocket 92 so that it can rotate on the sprocket. As seen best in FIG. 5*a*, side 91 of housing 90 is truncated so that sprocket 92 and idler pulley 94 can extend outside of housing 90, allowing chain 40 to enter housing 90 adjacent side 91, wrap around sprocket 92, and exit housing 90 from an inlet 89 located at a surface opposite of surface 91. Likewise, a second cable 42 may enter housing 90 at the aperture located adjacent to side 91, wrap around idler pulley 94, and exit housing 90 from the inlet 89. As seen in FIG. 1, a driving apparatus 50 is preferably located at each end 22 of track 12. Of course, if only a single shade member were used, only one driving apparatus 50 would be needed.

Figure 9:
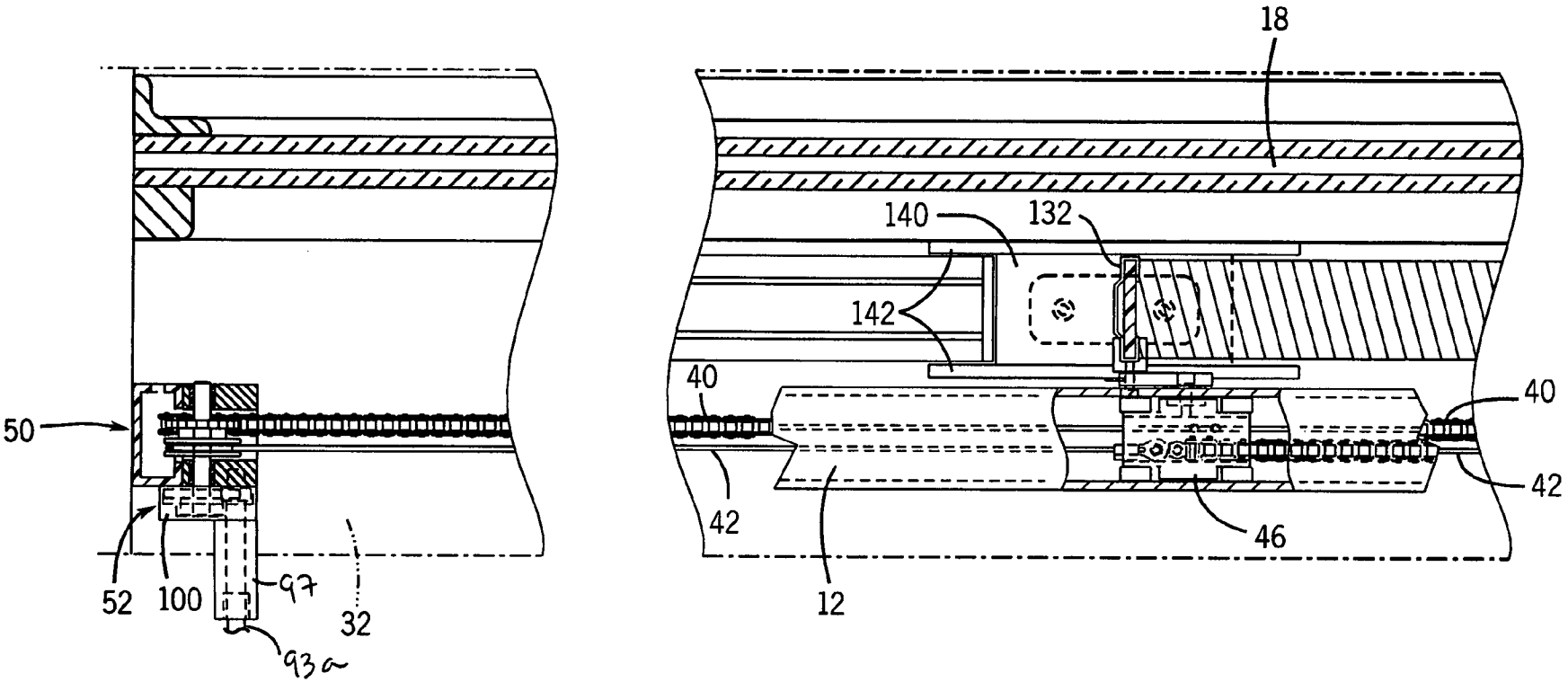
FIG. 9 is a partial cut-away view of the window covering shown in FIG. 1, specifically showing how the chains and cables are oriented within the track.
Figure 10:
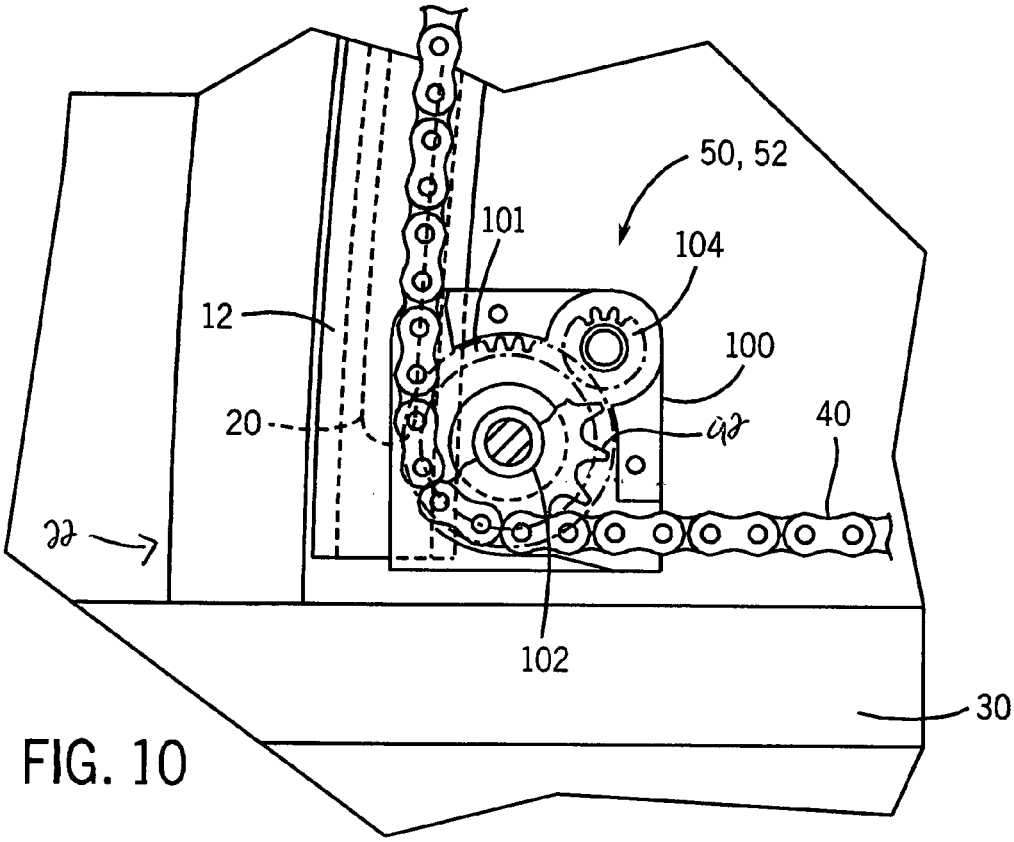
FIG. 10 is a rear partial cut-away view of the window covering shown in FIG. 1, showing the gear assembly in relation to the driving apparatus.
Figure 10A:
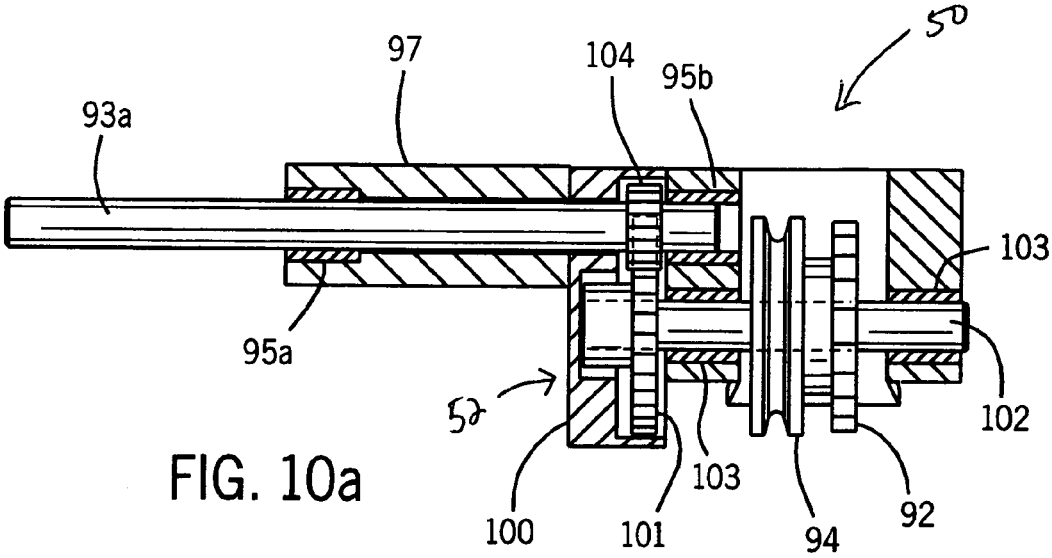
FIG. 10*a* is a top cut-away view of the driving apparatus and gear assembly shown in FIG. 10.

In the most preferred embodiment of the present invention, a gear assembly 52 engages the driving apparatus 50 to reduce the amount of effort needed to operate shade member 16. Referring to FIGS. 9, 10, and 10*a*, gear assembly is housed in a gear housing 100. A large gear 101 is connected to the common shaft 102 that is supported by bushings 103. A reduction gear 104 engages large gear 101, and is connected to a drive shaft 93*a*. Drive shaft 93*a* is supported by bushings 95*a* and 95*b* and by a drive shaft support 97. A gear reduction of 12/34 or 0.352 is preferred, but other gearing reductions are possible. Further, other types of gear configurations may be used.

The drive assembly may be constructed from other elements than a chain and cable. For example, the entire loop could be formed by a chain. Alternatively, other types of cords or ropes could be used (e.g. timing cable or bead chain). Of course, for cords or ropes may not be able to engage a sprocket as described above. Sprocket alternatives would be necessary. For instance, a narrow band could be used in conjunction with friction wheels, or a cable drive could be used in conjunction with knurled pulleys. Preferably, the components that occupy track 12 are made of material that creates too much friction against the track. Too much friction would unnecessarily increase the force required to open and close the shade members 16.

Referring to FIGS. 4 and 5, a rotator assembly 54 is attached to the drive shaft 93 of driving apparatus 50 or the drive shaft 93*a* of gear assembly 52. With either embodiment, rotational movement of sprocket 92 occurs when pull cord 56 is pulled. The rotation of sprocket 92 causes the movement of the chain 40 engaged thereto. The rotator assembly 54 preferably includes a housing 112 with a cover member 114. Inside the housing member 112 is a pulley hub 116. Pulley hub 116 has a connecting surface 118 which engages an activator such as pull cord 56. The cover member 114 keeps the pulley hub 116 in place and hides the internal workings of the rotator assembly 54. Preferably, pull cord 56 is a continuous loop.

In another embodiment of the present invention, the rotator assembly may be a motor (not shown) instead of a pulley operated by a pull cord. Any activator that can be used to rotate the driving apparatus is appropriate.

Referring to FIGS. 4 and 6, each shade member 16 may be attached to a carriage 46 with an attachment arm such as clip member 74. Preferably, clip member 74 has an L-shaped arm 120 with a forked slot 122 on the shorter portion of the arm 120, and a shoulder 124 extending from the longer portion of arm 120. Forked slot 122 is preferably a groove that has a narrower elongated slit extending into the arm 120 at the apex of slot 122. Shoulder 124 is shaped to fit into the recess 70 located on the carriage 46. An aperture 126 extends through the clip member, and is aligned with the aperture 72 (located in recess 70) so that the clip member can be fastened to carriage 46 with a fastener (not shown). Clip member 74 may be machined from a material such as metal (e.g. aluminum alloy) or molded from a material such a plastic or the like, and acts as a quick release device for easy shade member removal.

Figure 12A:
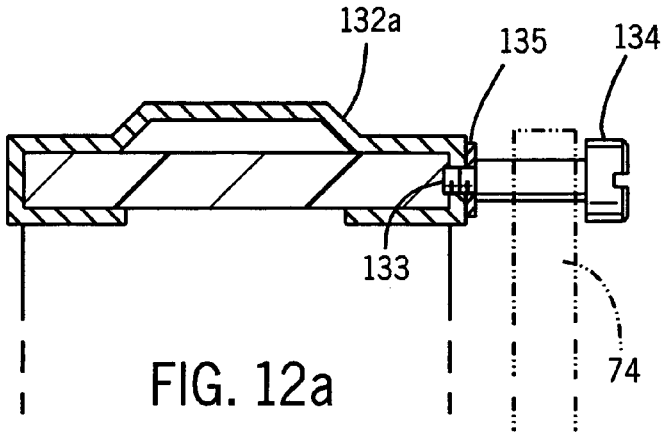
FIG. 12*a* is a side elevational view of another embodiment of a head rail for the window covering of FIG. 1.
Figure 12:
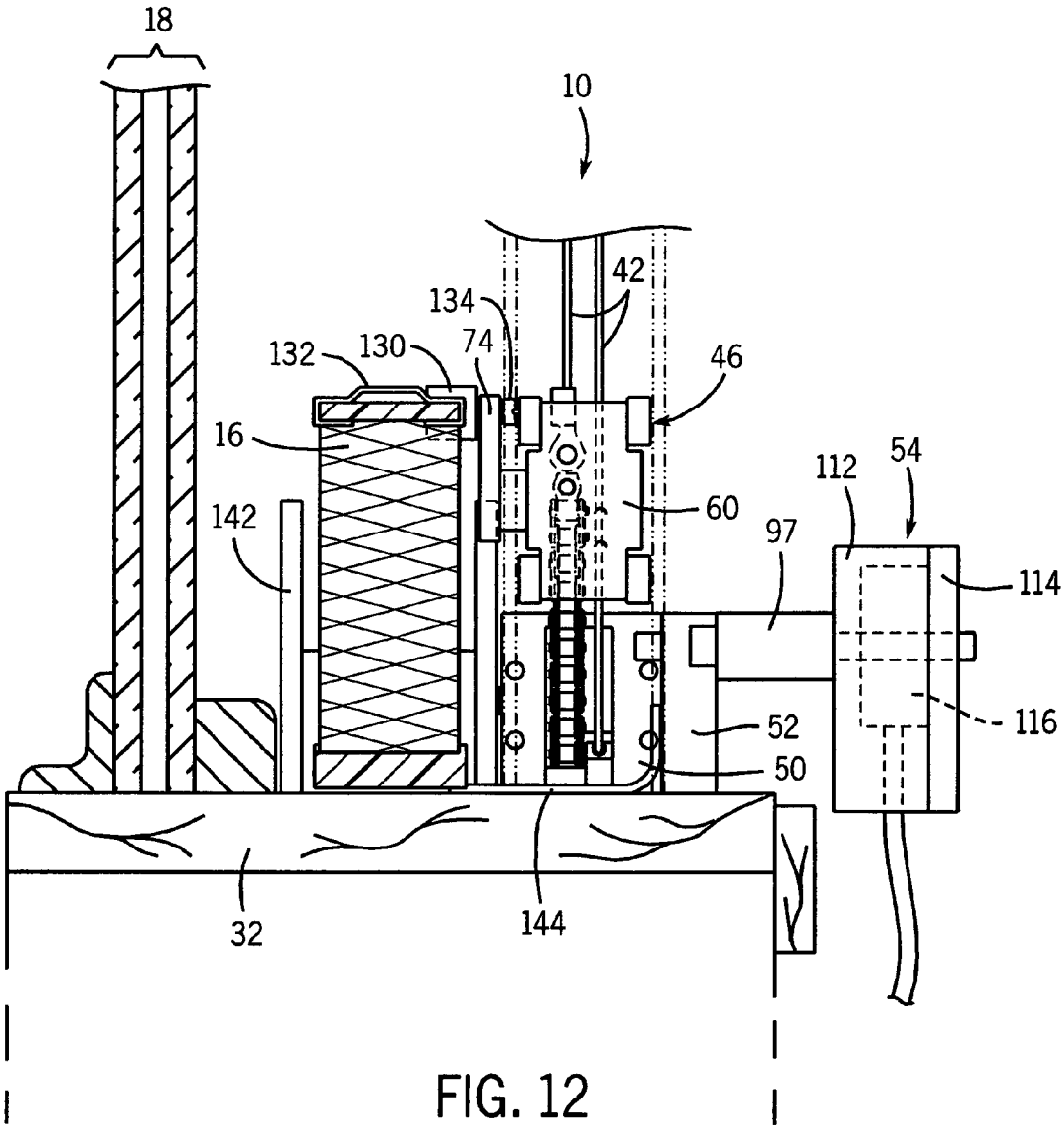
FIG. 12 is a partial side cut-away view of the shade member in relation to the driving apparatus, gear and rotator assemblies and the window, and further showing a sill extension member.
Figure 13:
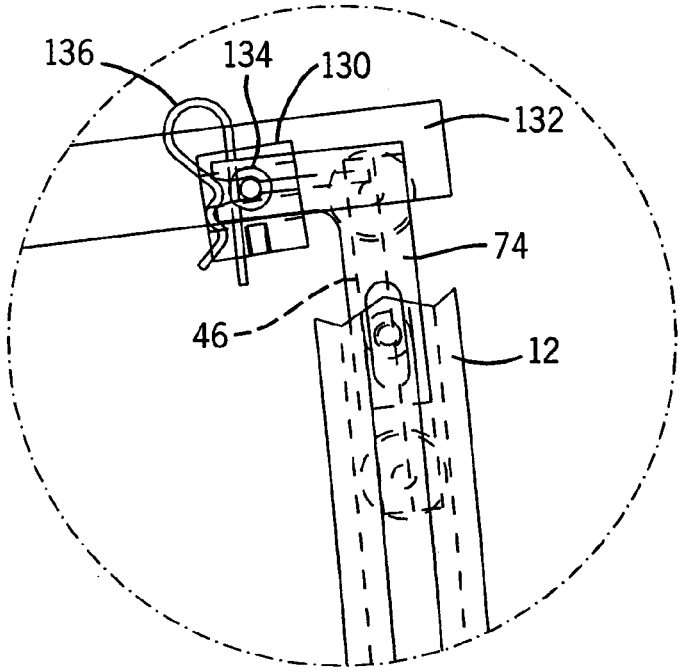
FIG. 13 is a partial view of the of the window covering shown in FIG. 1, specifically showing the clip member attached to the cuff.
Figure 16:
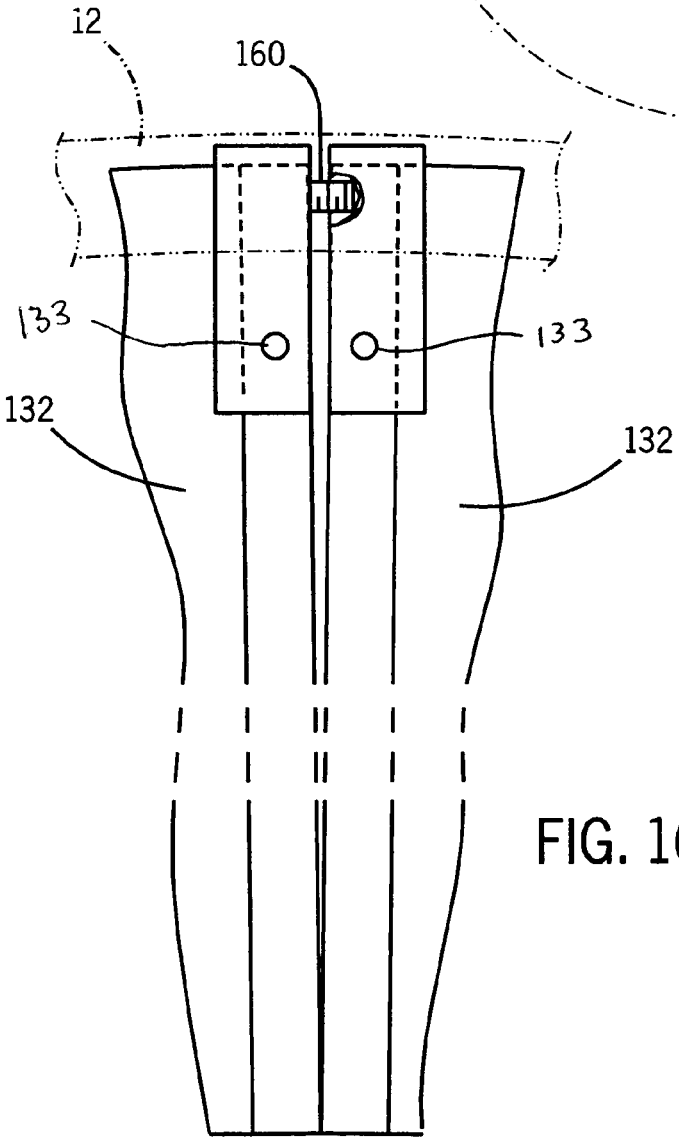
FIG. 16 is a partial front view of the window covering shown in FIG. 2, showing a pivoting device or set screws used to adjust the gap between the shade members.

Referring to FIGS. 4 and 12, cuff 130 is a short bracket that may wrap around an edge of a head rail 132 of shade 16. Cuff 130 is used when it is undesirable to modify the shade member for attachment to clip member 74. Cuff 130 has a fastener 134 attached thereto so that is extends outwardly toward track 12. Fastener 134 has a head and a necked portion, the necked portion fitting into the slot 122 of clip member 74. Preferably, fastener 134 selectively snaps in and out of slot 122 so that the shade member can be easily removed and replaced from the window. Shown in FIG. 13 is a close-up view of cuff 130, wherein a cotter pin 136 keeps the fastener 134 from falling out of slot 122. As seen in FIGS. 4 and 13, cuff 130 may vary in length. Further, cuff 130 may have different profiles that are adaptable to the head rails of various shade manufacturers.

In an alternative embodiment, cuff 130 is not used, and the fastener 134 is attached directly to the head rail 132. Referring to FIG. 12*a*, a head rail 132*a* (head rail profile may vary) has an aperture 133 therein where fastener 134 is attached. Preferably, aperture 133 is threaded. A washer 135 may be used to prevent the clip 74 from contacting 132*a* directly. By preventing direct contact, head rail 132*a* will not become marred by clip 74 in the raising and lowering of shade member 16.

Shade member 16 may be constructed from expandable shades that can be compressed on one side while being stretched on an opposite side. Thus, shade member 16 is preferably a pleated shade, or cellular shade having single, double or triple cells. A double cellular shade is most preferred, however, any shade having adequate stiffness to prevent sagging may be used. Shade members 16 are commonly available rectangular shades, and may be obtained from various commercial shade manufacturers such as HUNTER DOUGLAS, GRABER, AMERICAN and the like. This way, it is possible for the home owner to match the shade member 16 to the rest of the window coverings used in the home. This is a distinct advantage, especially if the other window coverings used in the home have a distinctive color or texture. Commercially available shades have some type of head rail 132, as mentioned previously, and a bottom rail 138 (which is typically the top rail if the shade 16 were hung in a rectangular window). The head rail 132 is the movable edge, and the bottom rail 138 is a static edge.

Figure 11:
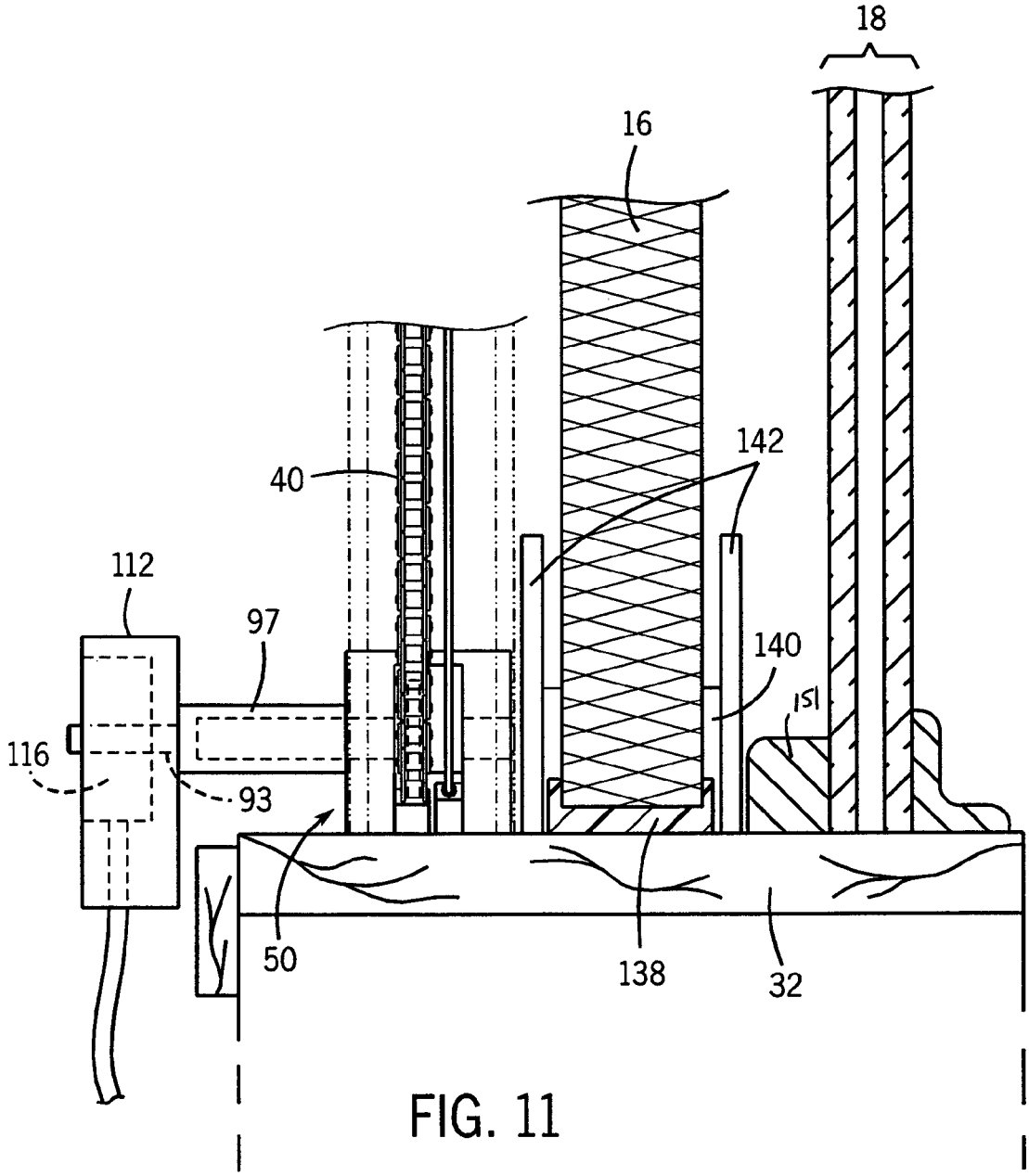
FIG. 11 is a partial side cut-away view of the shade member in relation to the driving apparatus, rotator assembly and the window.
Figure 14:
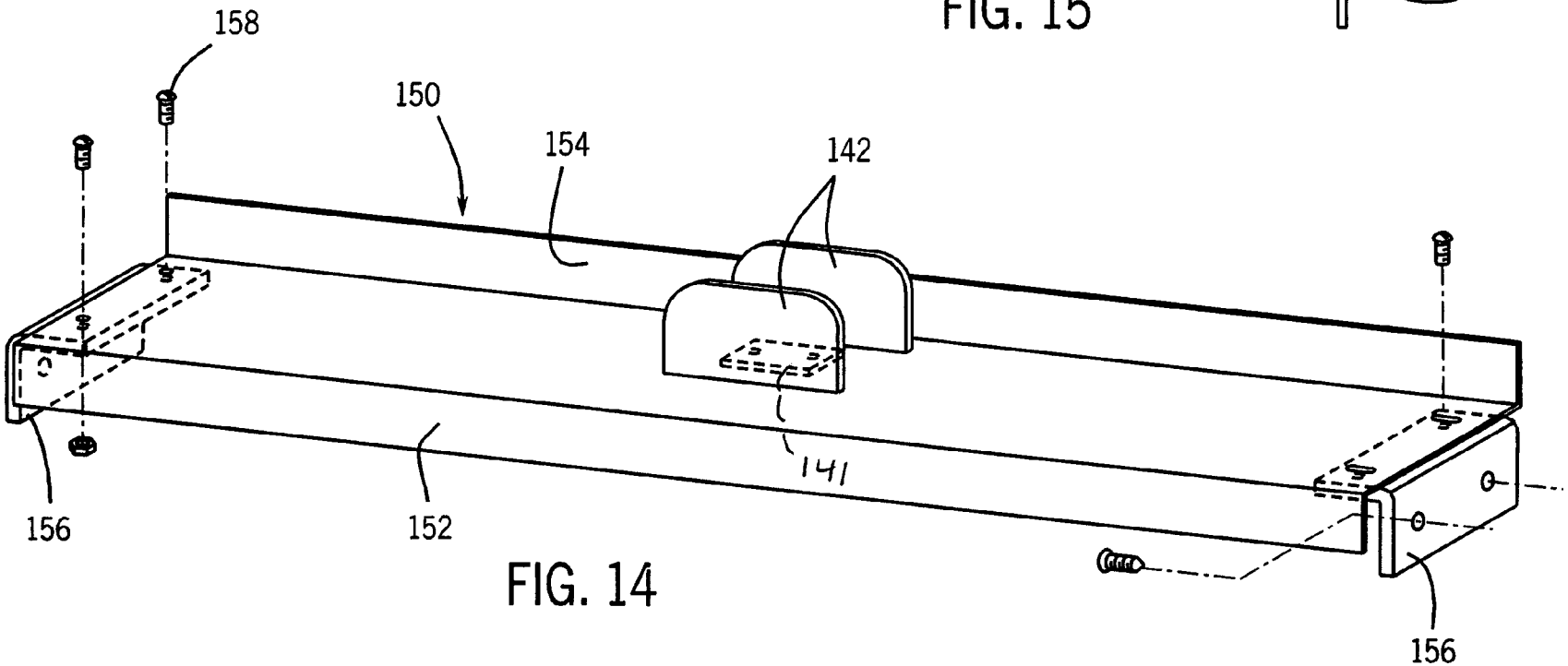
FIG. 14 is a front perspective view of the sill plate member that is used for windows without sills.
Figures 17, 18:
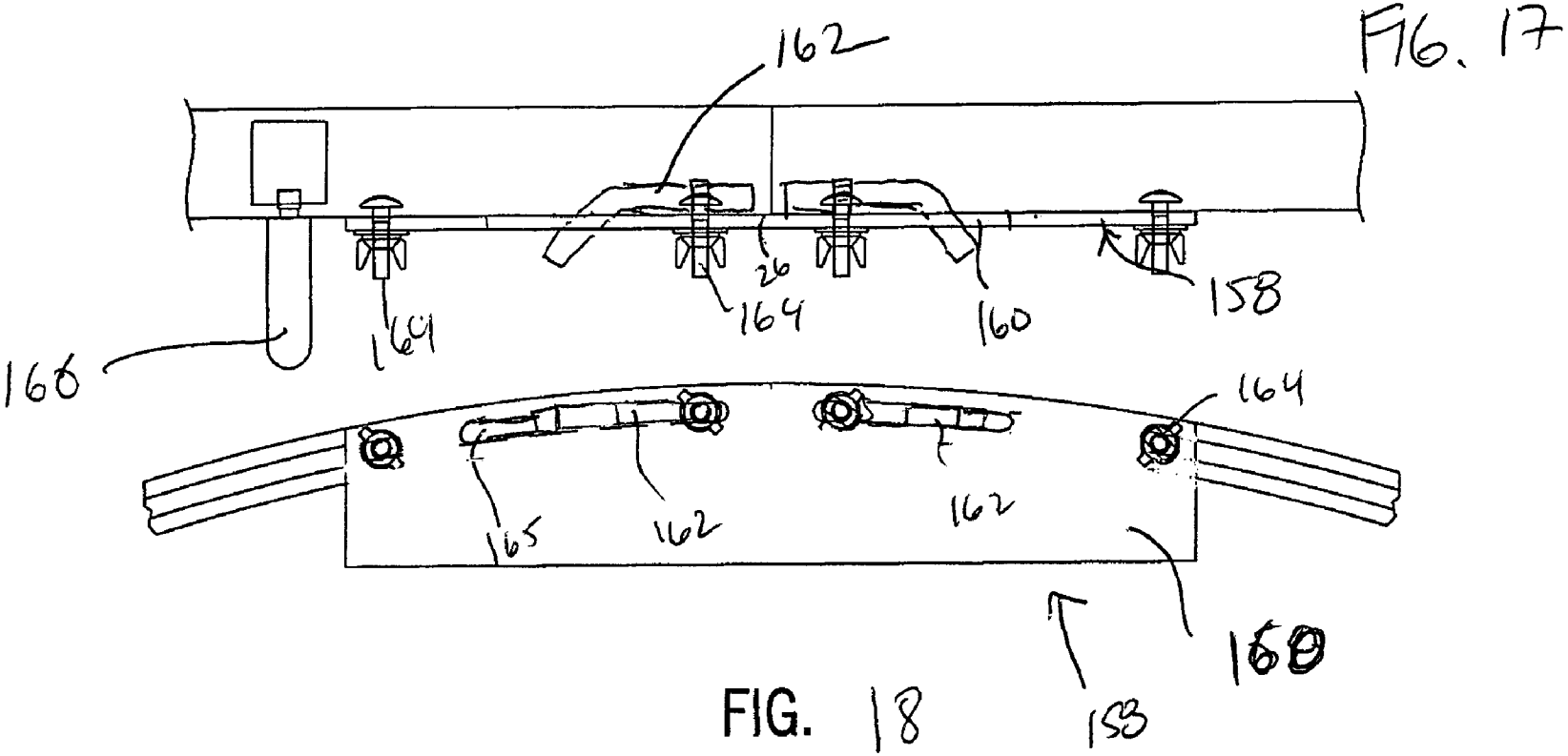
FIG. 17 is a partial plan view of a temporary compression bracket used to abut two halves of a frame together during installation.
FIG. 18 is a front elevational view of the compression bracket shown in FIG. 17.

Each bottom rail 138 may rest on a sill 32 or the like as seen in FIGS. 11 and 12. (For windows without sills, another horizontal surface such as a bracket is used, as seen in FIG. 14.) Referring to FIGS. 3 and 11, some sills 32 are deep enough to accommodate the covering 10. Preferably, a hub 140 is attached to the sill 32 (or other structure as shown herein) and used to separate shade members 16. Hub covers 142 may attached to the hub 140 to cover it, and can be designed to be any shape or have any amount of aesthetic value that is desired. Hub covers 142 may be used at both the front and back of the shade member 16 if desired. It is noted that shade members 16 do not necessarily contact the hub 140 as the shade member moves from a stacked position to an unstacked position. Preferably, zero contact is made between hub 140 and shade 16 with the exception of bottom rail 138 to prevent the hang-up of shade member 16 as it moves to the unstacked position.

Preferably, the hub 140 has a detent on its bottom surface that aligns with a hub keeper 141 as seen in FIGS. 3 and 14. Hub keeper 141 is a plate that is attached to sill 32 or the like. The hub 140 detent is placed over hub keeper 141 so that hub 140 cannot slide about. Preferably, hub 140 may be lifted off for easy cleaning of sill 32.

Referring to FIG. 12, some sills 32 are too shallow to completely accommodate covering 10. In this case, a sill extension such as tray 144 may be used to hide and/or support each cable/chain combination. Tray 144 is preferably a lipped tray that extends between each end 22 of track 12.

Figure 15:
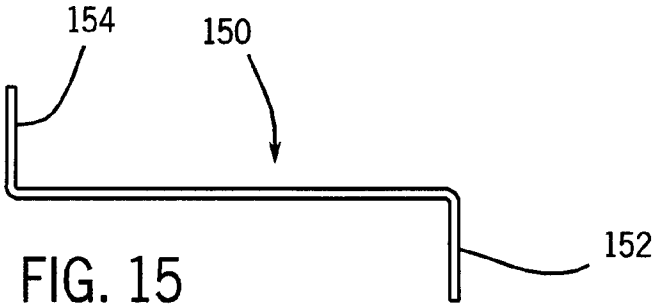
FIG. 15 is a side elevational view of the sill plate member shown in FIG. 14.

Referring to FIGS. 14 and 15, some windows do not have sills, and require a support bracket such as sill plate 150. Sill plate 150 is a substitute for a sill 32. Sill plate 150 is preferably a flat plate having a front lip 152 angled downward at a right angle and an optional rear lip 154 angled upward at a right angle. Angle brackets 156 may be used to attach sill plate 150 to the window frame (not shown). Sill plate 150 may be attached to the brackets 156 with fasteners 158 as shown. Likewise, brackets 156 may attach to the window frame with fasteners. Sill plate 150 may have other configurations. For instance, the front lip 152 could be extended above the plate, oriented in the opposite direction, or be omitted completely.

When the shade members 16 are completely closed as seen in FIG. 2, an uneven gap may occur between the head rails 132 near hub 140. Therefore, it is preferable to attach a pivoting device such as one or a pair of set screws 160 to the top edge of each head rail, see FIG. 16. Set screws 160 extend outwardly from head rail 132 towards the gap created therebetween. Changing the extent to which the set screws extend toward the gap can pivot the head rails slightly and cause the gap to be uniform and of a minimal width. The pivot of either shade member occurs at the corresponding connection 133 between the clip member 74 and fastener 134 that extends from the head rail of shade 16. Preferably, the gap is approximately one millimeter or less in width. One or more detachable or fixed bosses (not shown) may be used instead of adjustable set screws.

Referring to FIGS. 1, 11, 17 and 18, to install the covering 10 to a window 18 the following procedure may be used. The channel of track 12 is threaded with the drive assembly. Track 12, if supplied in two pieces for shipping purposes is assembled on a flat surface such as the floor with the track 12 slot facing downward. To aid in assembly, it is preferable to use a temporary compression bracket 158 to abut the two halves of frame 12 together so that it can be lifted at a unitary piece. Compression bracket is a flat plate 160 that has a pair of clips 162 that can slidably move within a pair of corresponding slots 165 that are located in plate 160. By placing each clip 162 into the track slots, firmly abutting the two halves of track 12 together, sliding the clips 162 beneath the corresponding slot bridge 26 and toward each other as far as they will go, and finally tightening threaded fasteners 164, the track can be easily transported to the window frame for permanent attachment thereto. Once the track 12 is attached to the window frame, the bracket 158 can be removed and discarded.

So that the track 12 is attached a uniform distance from the window 18 surface, spacers 160 are also temporarily attached to the track 12 at slot 20. Preferably, the spacers 166 are uniformly sized pegs that have a necked portion that is friction fit into the slot 20. Spacers are placed along the length of track 20, preferably at marked intervals. The covering 10 is then placed against the window 18 (or the framing material surrounding the window 18 such as the stop strip 155, seen in FIG. 11) and track 12 is attached to the window frame. Preferably, the track 12 is attached to the window frame by driving threaded fasteners (not shown) from the track channel through the top surface of track 12 at spaced intervals along track 12. As seen in FIG. 4, access holes 151 at the track inner surface 153 allow the fasteners to be placed within the track channel.

Next, each driving apparatus 50 may be adjusted upwardly or downwardly so that they rest against the sill 32 or sill plate 150. The chain 40 and cables 42 are then connected with the turnbuckle fasteners 44 as described above, and the tension adjusted. The spacers are removed, and the rotator assemblies 54 attached to covering 10. The hub 140 is centrally placed between the ends 22 of track 12 and fastened to the sill 32 or sill plate 150. Shade members 16 are set onto the sill or sill substitute and attached to the carriage 46 with the clip member 74. For easy cleaning, the shade members 16 may be detached from clips 74 and lifted away from the window. Likewise, the hub 140 may be lifted off.

In operation, the rotator device is activated, for example, pull cords 56 are pulled separately to raise or lower the corresponding shade member 16. Each shade member 16 may be closed partially at any distance along the track 12.

Although the invention has been herein shown and described in what is perceived to be the most practical and preferred embodiments, it is to be understood that the invention is not intended to be limited to the specific embodiments set forth above. For example, one shade member may be used instead of two shade members. Further, the covering is not limited to a semi-circular shape as depicted in the drawings. The covering arc could be a significantly less than a quarter-round, or even greater than 180 degrees. Accordingly, it is recognized that modifications may be made by one skilled in the art of the invention without departing from the spirit or intent of the invention and therefore, the invention is to be taken as including all reasonable equivalents to the subject matter of the appended claims.

The invention claimed is:

1. A retractable window covering for covering an arched window, the window covering comprising:

an arched track having an interior channel, a first end and a second end;

a first carriage that is movable within the interior channel of the arched track;

a first shade member having a movable edge and an opposite static edge, wherein one end of the movable edge is connected to the first carriage; and a first drive assembly that forms a single closed loop, the first drive assembly disposed within the interior channel and extending between the first end and the second end of the track;

a second carriage that is movable within the interior channel of the arched track;

a second shade member having a movable edge and an opposite static edge, wherein one end of the movable edge is connected to the second carriage; and a second drive assembly that forms a single closed loop, the second drive assembly disposed within the interior channel and extending between the first end and the second end of the track.

2. The retractable window covering of claim 1, further including a first driving apparatus which is connected to the first end, and a second driving apparatus which is connected at the second end, wherein the first drive assembly and the second drive assembly each engage both the first driving apparatus and the second driving apparatus.

3. The retractable window covering of claim 2 wherein the first driving apparatus and the second driving apparatus further each includes a gearing assembly to reduce the force required to open and close the first shade member and the second shade member.

4. The retractable window covering of claim 3 wherein the first and second shade members are selected from the group consisting of a pleated shade and a cellular shade.

5. The retractable window covering of claim 3 wherein the first driving apparatus and the second driving apparatus further each includes an activator for selectively retracting and opening the first shade member and the second shade member.

6. The retractable window covering of claim 1, wherein the first driving apparatus and the second driving apparatus further each includes an activator for selectively retracting and opening the first shade member and the second shade member.

7. A retractable window covering for covering an arched window with a frame, the window covering comprising:

an arched track having an interior channel, a first end and a second end;

a first carriage and a second carriage that are each movable within the interior channel of the arched track;

a first shade member having a movable edge and an opposite static edge, a compressible side and an expandable side, wherein the movable edge is connected to the first carriage;

a second shade member having a movable edge and an opposite static edge, wherein an end of the movable edge is connected to the second carriage;

a first driving apparatus and a second driving apparatus, and wherein the first driving apparatus and the second driving apparatus further each includes an activator for selectively retracting and opening the first shade member and the second shade member; and a drive assembly that forms a closed loop, wherein the drive assembly is disposed within the interior channel of the arched track, engages the first driving apparatus and a second driving apparatus, and extends between the first end and the second end of the track.

8. The retractable window covering of claim 7 wherein the arched track has a slot substantially extending the length of a rear surface between the first end and the second end of the arched track.

9. The retractable window covering of claim 7 wherein the first driving apparatus and the second driving apparatus each includes a gearing assembly to reduce the force required to open and close the first shade member and the second shade member.

10. The retractable window covering of claim 7 wherein the first shade member is attached to the first carriage with a first attachment arm, and the second shade member is attached to the second carriage with a second attachment arm.

11. The retractable window covering of claim 7 wherein the first shade member is connected to the drive assembly with a quick release device.

12. The retractable window covering of claim 7 further including a pivoting device for closing any uneven gap that may occur between the first shade member and the second shade member when they are both positioned to completely cover the arched window.

13. The retractable window covering of claim 7 wherein the first shade member and the second shade member are separated by a hub that is placed on a horizontal surface that spans a distance between the first end and the second end of the track.

14. The retractable window covering of claim 7 wherein the arched track is semicircular in shape.

15. The retractable window covering of claim 7 wherein a horizontal surface spans a distance between the first end and the second end of the track, the horizontal surface selected from the group consisting of a sill plate, a support bracket and a sill extension.

16. An apparatus for adapting straight shades to an arched window, the apparatus comprising:

an arched track having an interior channel, a first end and a second end;

a first carriage and a second carriage that are each movable within the interior channel of the arched track;

a first driving apparatus and a second driving apparatus; and a drive assembly that forms a closed loop, wherein the drive assembly is disposed within the interior channel of the arched track, engages the first driving apparatus and a second driving apparatus, and extends between the first end and the second end of the track.

17. The apparatus of claim 16 wherein the first driving apparatus and the second driving apparatus each includes an activator for selectively moving the first carriage and the second carriage.

18. The apparatus of claim of claim 16 wherein the arched track is comprised of two separate parts that are abutted together.

19. The apparatus of claim 16 further including a hub located substantially at the center of a distance between the first end and the second end of the track.

20. The apparatus of claim 19 further including a drive shield for shielding a portion of the drive assembly from view.

21. The apparatus of claim 19 further including a sill extension for adapting the apparatus to a window having a shallow sill.

22. A method of installing a retractable window covering for an arched window having a window frame, the method comprising the steps of:

attaching an arched track to the window frame, the arched track having a first carriage and a second carriage movable within an interior channel of the arched track;

attaching a drive assembly to the arched track; and attaching a first shade member to the first carriage and a second shade member to the second carriage.

* * * * *